US012692672B2

(12) United States Patent
Halonen et al.

(10) Patent No.: US 12,692,672 B2
(45) Date of Patent: Jul. 28, 2026

(54) CONCRETE SURFACE WORKING MACHINE WITH ACTUATOR-CONTROLLED ROCK TAMPER

(71) Applicant: Somero Enterprises, Inc., Ft. Myers, FL (US)

(72) Inventors: Philip D. Halonen, Calumet, MI (US); Mark A. Pietila, Atlantic Mine, MI (US); James E. Kangas, Calumet, MI (US); Matthew A. Kangas, Atlantic Mine, MI (US)

(73) Assignee: Somero Enterprises, Inc., Ft. Myers, FL (US)

( * ) Notice: Subject to any disclaimer, the term of this patent is extended or adjusted under 35 U.S.C. 154(b) by 658 days.

(21) Appl. No.: 18/299,089

(22) Filed: Apr. 12, 2023

(65) Prior Publication Data

US 2023/0332361 A1 Oct. 19, 2023

Related U.S. Application Data

(60) Provisional application No. 63/362,901, filed on Apr. 13, 2022.

(51) Int. Cl.

| | |
|---|---|
| ***E01C 19/28*** | (2006.01) |
| ***E01C 19/23*** | (2006.01) |
| ***E01C 19/41*** | (2006.01) |

(52) U.S. Cl.

CPC ..... *E01C 19/286* (2013.01); *E01C 19/236* (2013.01); *E01C 19/285* (2013.01); (Continued)

(58) Field of Classification Search

CPC .... E01C 19/286; E01C 19/236; E01C 19/285; E01C 19/41; E01C 2301/14; E01C 2301/16; E01C 19/405

See application file for complete search history.

(56) References Cited

U.S. PATENT DOCUMENTS 1,584,385 A * 5/1926 Lichtenberg ..... E01C 19/29 404/119
2,988,971 A * 6/1961 Loucks ..... E01C 19/40 404/113

(Continued)

FOREIGN PATENT DOCUMENTS

EP 3916173 A1 12/2021

OTHER PUBLICATIONS

International Search Report and Written Opinion dated Jul. 6, 2023 for corresponding PCT Application No. PCT/US2023/018225.

(Continued)

*Primary Examiner* — Abigail A Risic
(74) *Attorney, Agent, or Firm* — HONIGMAN LLP

(57) ABSTRACT

A concrete surface working machine includes a base portion and a screed head mounted at the base portion. The screed head includes a grade setting device and a vibrating element attached at a frame of the screed head. The screed head includes a rock tamper adjustably attached at the frame of the screed head via a pair of support elements. The screed head includes a pair of actuators that, when actuated, adjust the support elements to adjust the rock tamper relative to the frame. The concrete surface working machine is operable to position the vibrating element at the concrete surface. The actuators are selectively controlled by an operator of the concrete surface working machine to adjust a height of the rock tamper relative to the vibrating element and the concrete surface while the screed head is moved along the concrete surface.

38 Claims, 12 Drawing Sheets

(52) U.S. Cl.
CPC ..... *E01C 19/41* (2013.01); *E01C 2301/14* (2013.01); *E01C 2301/20* (2013.01)

(56) References Cited

U.S. PATENT DOCUMENTS 3,515,043 A 6/1970 Austin
4,655,633 A 4/1987 Somero et al.
4,747,726 A * 5/1988 Garner ..... E01C 19/29 404/125
4,930,935 A 6/1990 Quenzi et al.
4,964,754 A * 10/1990 Garner ..... E01C 19/29 404/125
6,227,761 B1 5/2001 Kieranen et al.
6,976,805 B2 12/2005 Quenzi et al.
7,044,681 B2 5/2006 Quenzi et al.
7,121,762 B2 10/2006 Quenzi et al.
7,175,363 B2 2/2007 Quenzi et al.
7,311,466 B2 12/2007 Torvinen
7,396,186 B2 7/2008 Quenzi et al.
7,850,396 B2 12/2010 Pietila et al.
7,891,906 B2 2/2011 Quenzi et al.
8,038,366 B2 10/2011 Halonen et al.
8,075,222 B2 12/2011 Quenzi et al.
9,234,318 B2 1/2016 Pietila et al.
9,353,490 B2 5/2016 Pietila et al.
9,476,169 B1 10/2016 Knapp
9,835,610 B2 12/2017 Kangas
9,909,267 B1 3/2018 Ligman
10,060,900 B2 8/2018 Kangas
10,156,048 B1 12/2018 Springborg
10,190,268 B2 1/2019 Pietila et al.
10,895,045 B2 1/2021 Kangas
11,619,010 B2 * 4/2023 Guinn ..... E01C 19/4846 404/102
2007/0116520 A1 5/2007 Quenzi et al.
2010/0196096 A1 8/2010 Halonen et al.
2014/0363232 A1 12/2014 Pietila et al.
2018/0106056 A1 4/2018 Eenigenburg et al.
2018/0327982 A1 11/2018 Leukuma et al.
2019/0186083 A1 6/2019 Kangas
2020/0109526 A1 * 4/2020 Ligman ..... E01C 19/42
2020/0232168 A1 * 7/2020 Guinn ..... E01C 19/4846
2021/0131042 A1 5/2021 Kangas
2022/0064971 A1 3/2022 Halonen et al.
2022/0316154 A1 10/2022 Johnson et al.
2023/0009876 A1 1/2023 Pietila et al.

OTHER PUBLICATIONS

Extended European Search Report dated Jan. 5, 2026 from corresponding European Patent Application No. 23788871.4.

* cited by examiner

CONCRETE SURFACE WORKING MACHINE WITH ACTUATOR-CONTROLLED ROCK TAMPER

CROSS REFERENCE TO RELATED APPLICATION

The present application claims the filing benefits of U.S. provisional application Ser. No. 63/362,901, filed Apr. 13, 2022, which is hereby incorporated herein by reference in its entirety.

FIELD OF THE INVENTION

The present invention relates generally to concrete surface working machines for finishing of concrete that has been placed over a surface.

BACKGROUND OF THE INVENTION

Screeding devices or machines are used to level and smooth uncured concrete to a desired grade. Known screeding machines typically include a screed head, which includes a vibrating member and a grade setting device, such as a plow and/or an auger device. The screed head is vertically adjustable, such as in response to a laser leveling system. Some machines use a rock tamping element that pushes down the aggregate in the placed concrete. The rock tamping element is mounted at the screed head and is raised and lowered with the screed head. Examples of screeding machines are described in U.S. Pat. Nos. 4,655,633; 4,930,935; 6,227,761; 7,044,681; 7,175,363 and 7,396,186, which are hereby incorporated herein by reference in their entireties.

As shown in FIGS. 20 and 21, the rock tamping element is mounted to the screed head frame via respective spring-biased mounting tubes. The spring force exerted by the mounting tubes urges the rock tamper downward.

SUMMARY OF THE INVENTION

A concrete surface working machine for working or finishing or screeding a concrete surface includes a base portion and a screed head or concrete working head mounted at the base portion (such as at an end of an extendable and retractable boom that extends from the base portion). The concrete surface working machine is operable to selectively position the concrete working head at the concrete surface for a screeding or concrete working pass. The concrete working head includes a rock tamper adjustably attached at a frame of the head via a pair of support elements. The head includes a pair of actuators that, when actuated, adjust the support elements to adjust the rock tamper relative to the frame. The actuators are selectively controlled by an operator of the concrete surface working machine to adjust a height of the rock tamper relative to the frame and the vibrating element and the concrete surface being worked, such as before or after or during extension or retraction of the boom. For example, the actuator may be actuated to raise the rock tamper above the concrete surface while the concrete working head continues to work or process or finish or screed the concrete surface.

These and other objects, advantages, purposes and features of the present invention will become apparent upon review of the following specification in conjunction with the drawings.

DESCRIPTION OF THE PREFERRED EMBODIMENTS

Figure 1:
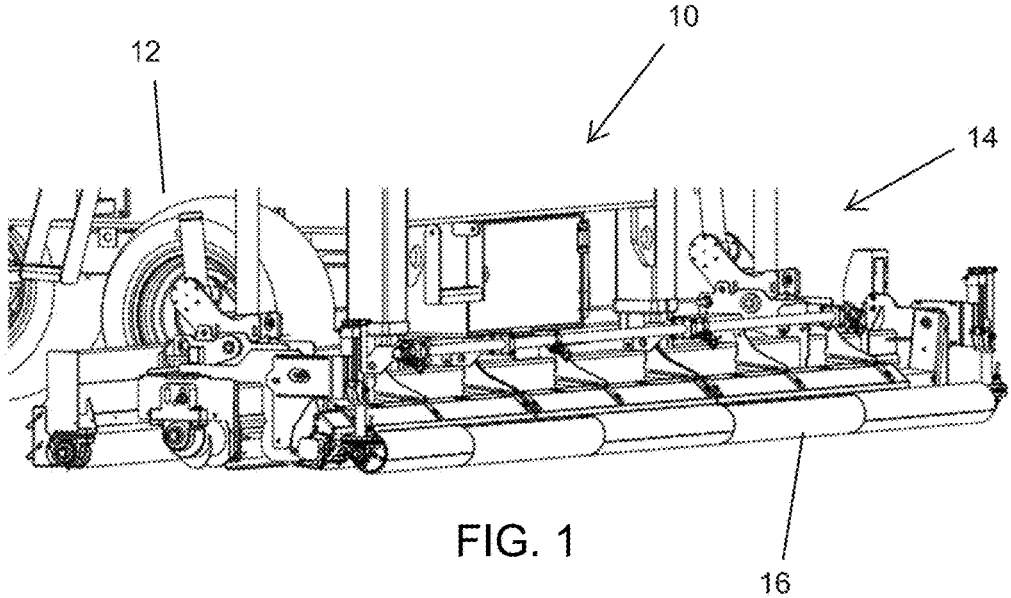
FIG. 1 is a perspective view of a screeding machine with a screed head and a rock tamper adjustably attached at the screed head via an actuator and a spring-loaded support at each end of the screed head.
Figure 2:
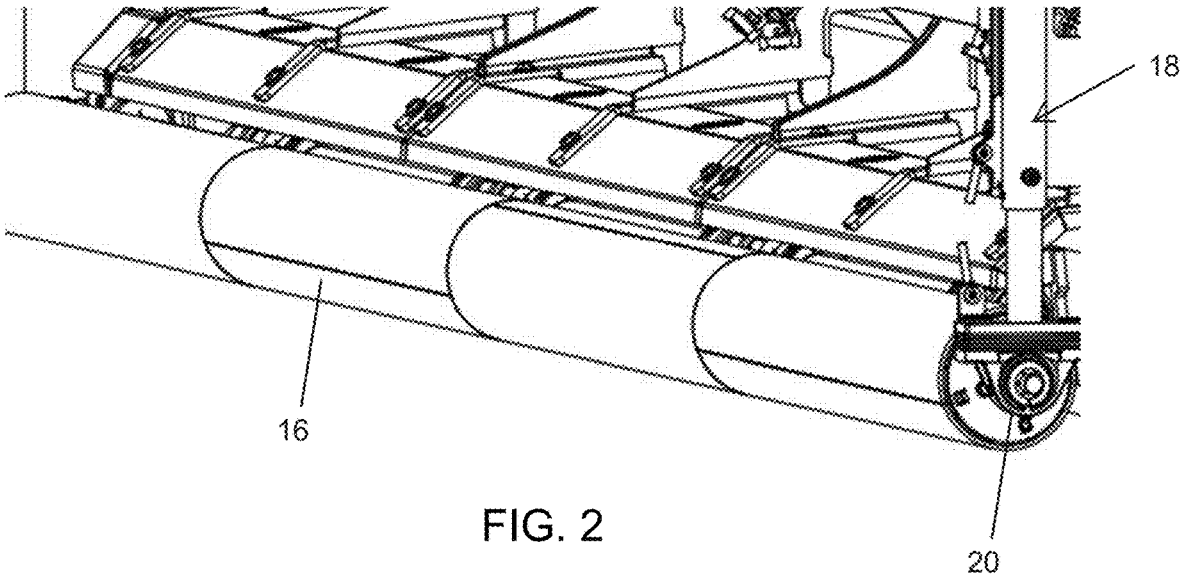
FIG. 2 is an enlarged perspective view of the rock tamper of the screeding machine of FIG. 1.
Figure 3:
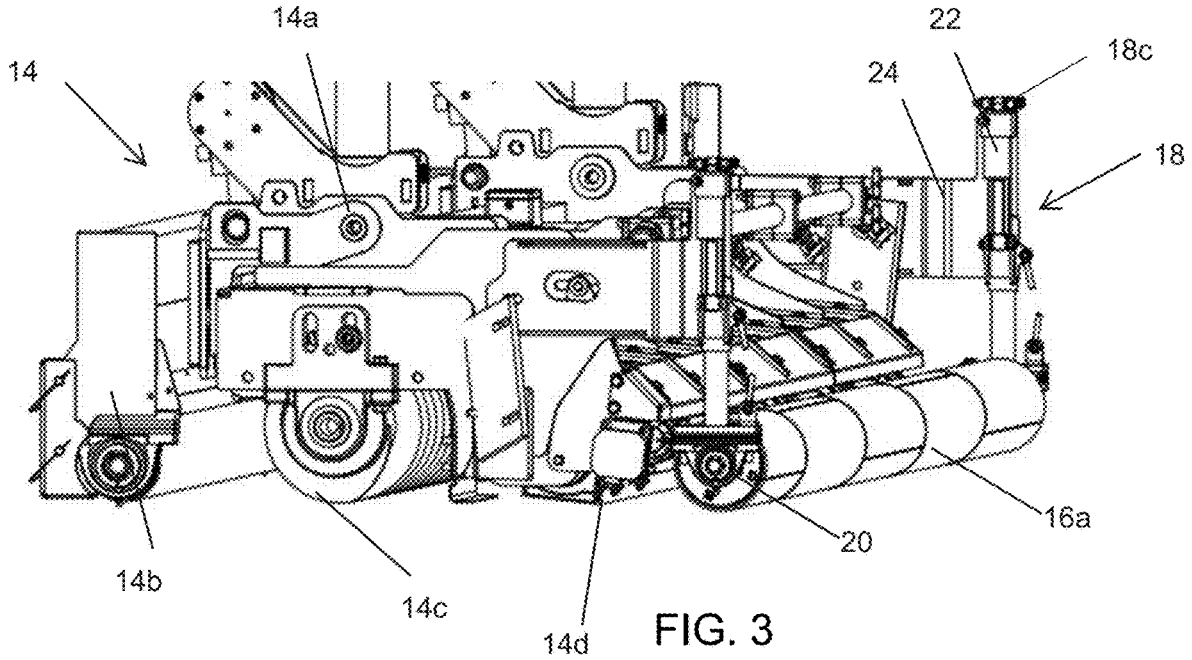
FIGS. 3 and 4 are perspective views of the screeding machine of FIG. 1.
Figure 4:
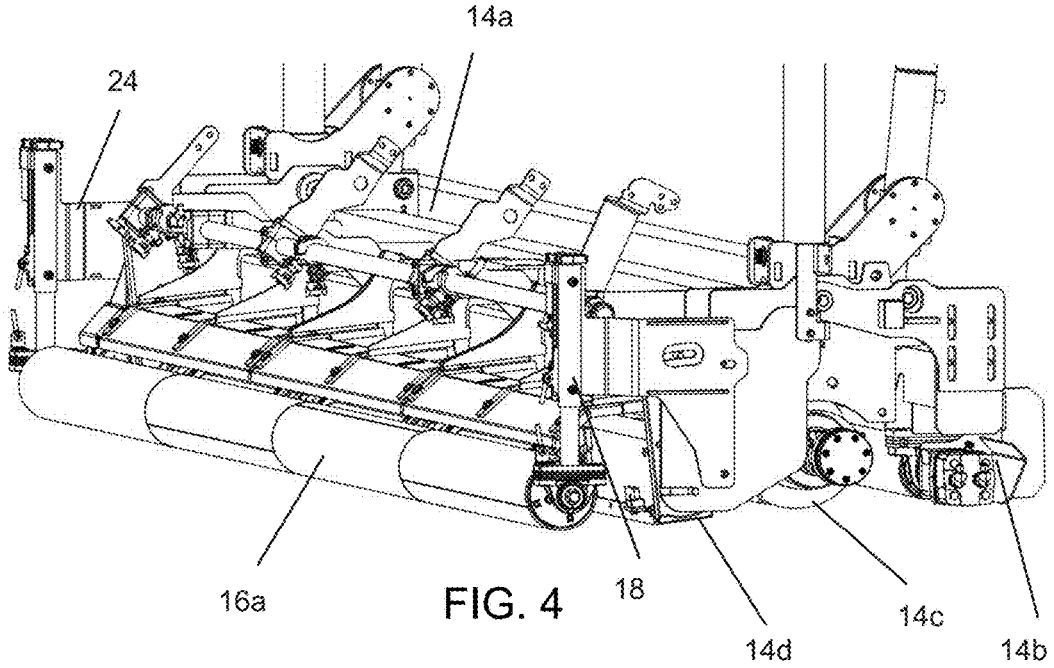
Figure 5:
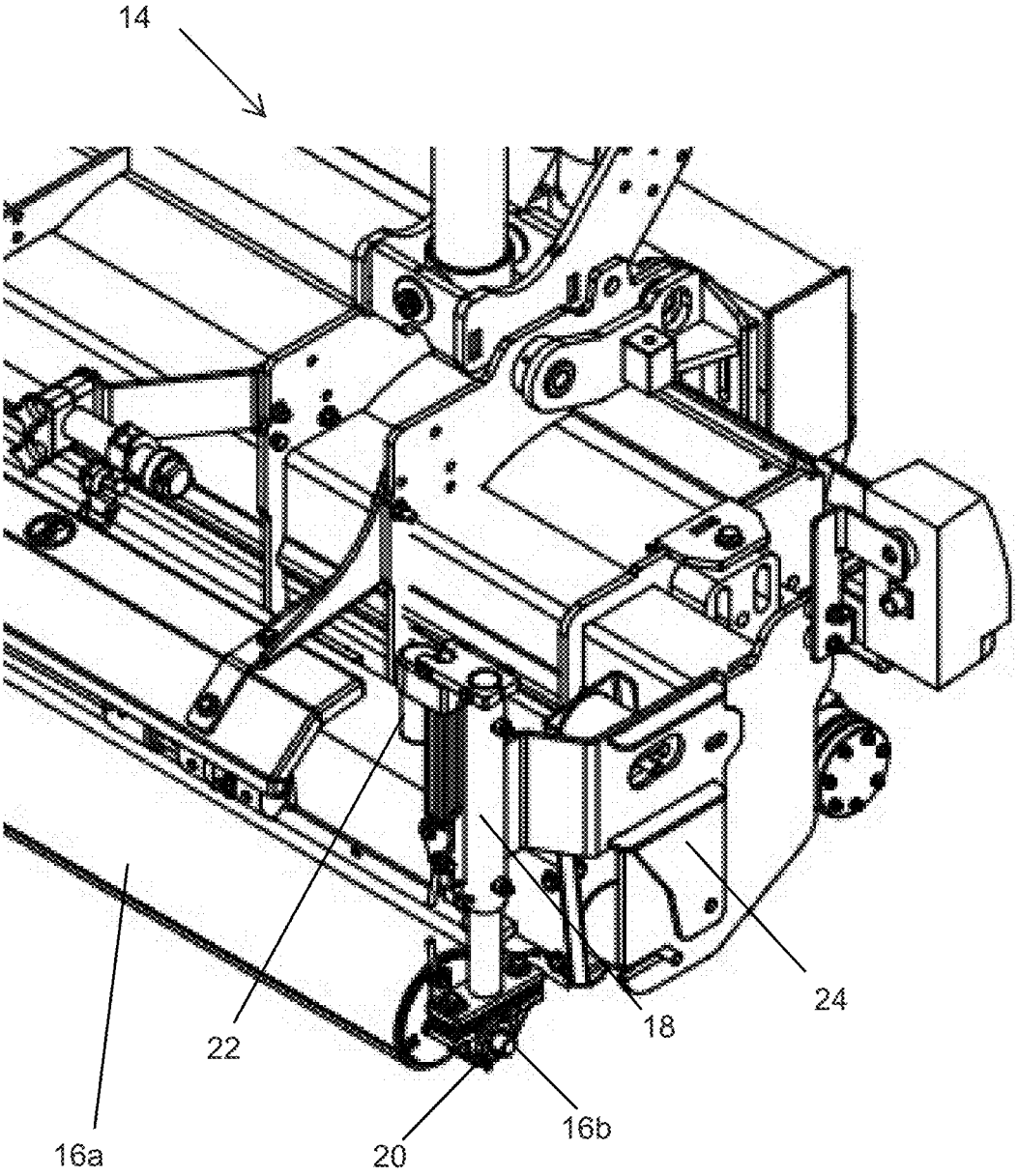
FIG. 5 is a perspective view of the end of the screed head of the screeding machine of FIG. 1.
Figure 6A:
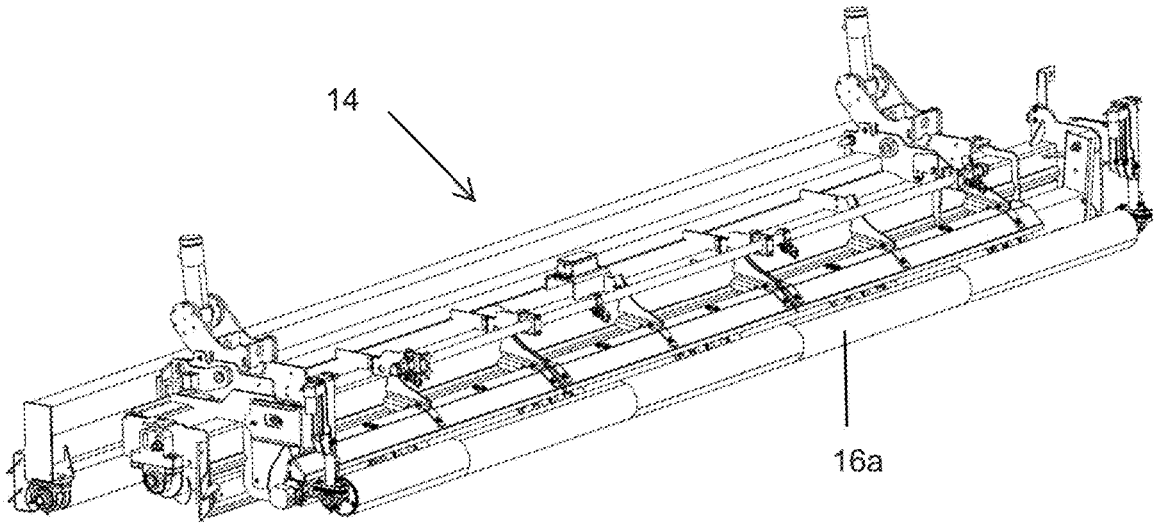
FIG. 6A is a perspective view of the screed head, with the rock tamper in its lowered position.
Figure 6B:
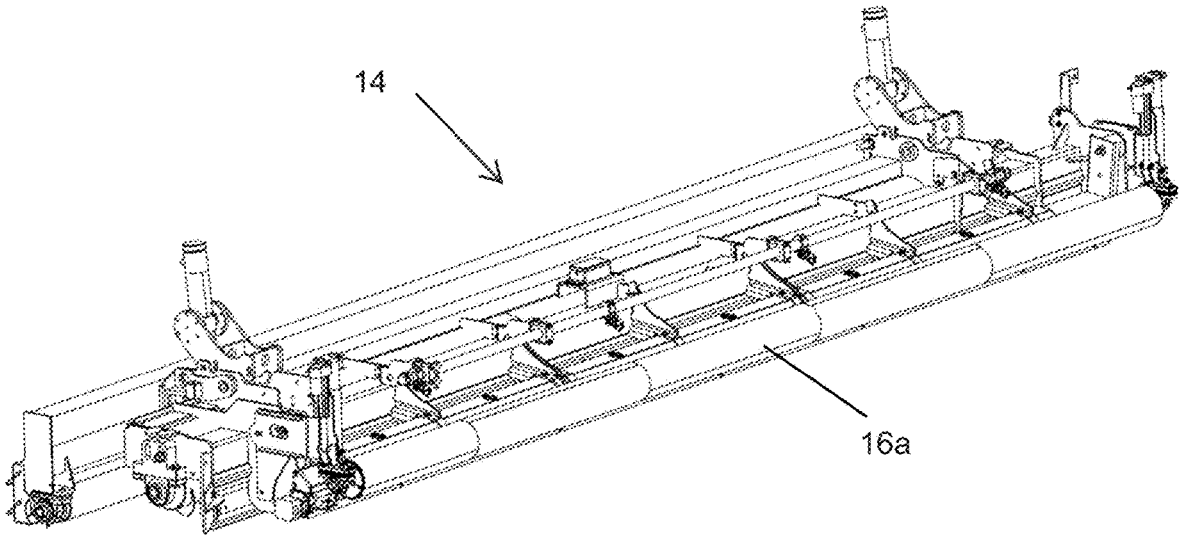
FIG. 6B is a perspective view of the screed head, with the rock tamper in its raised position.
Figure 7A:
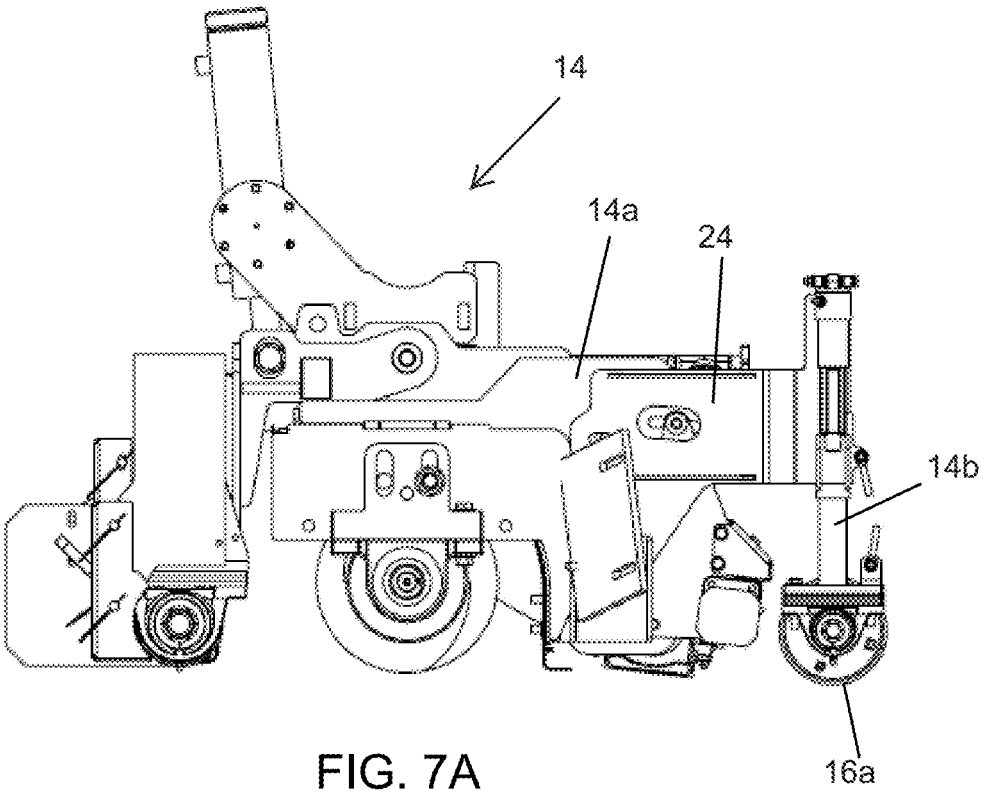
FIG. 7A is an end view of the screed head, with the rock tamper in its lowered position.
Figure 7B:
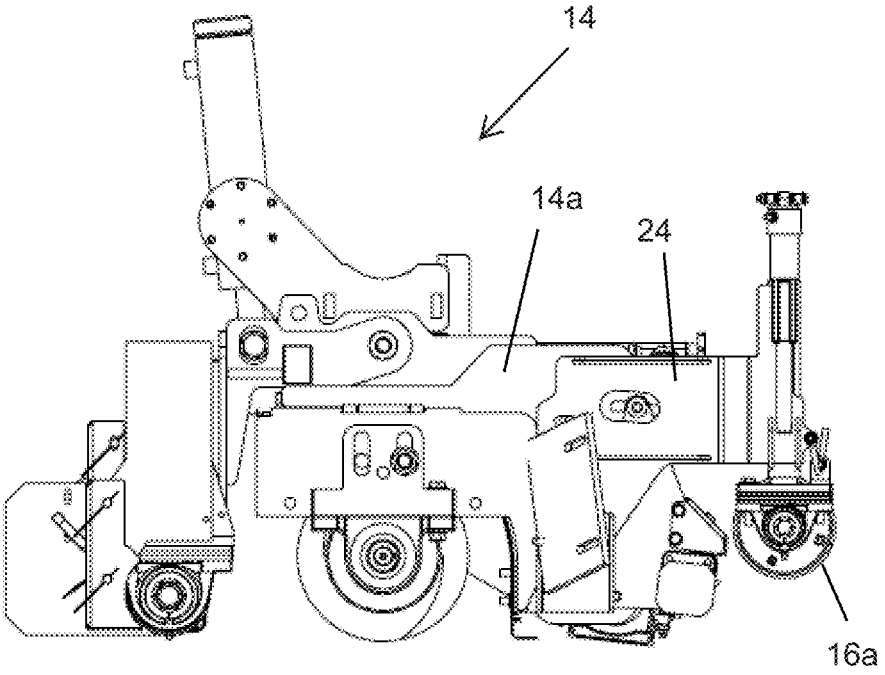
FIG. 7B is an end view of the screed head, with the rock tamper in its raised position.

Referring now to the drawings and the illustrative embodiments depicted therein, a concrete surface working machine 10 includes a base unit 12 (which may comprise a wheeled unit or may comprise any other form of base unit or structure) with a boom extending therefrom and supporting a screed head or assembly 14 at an outer end thereof (FIGS. 1-5). The base unit 12 is movable or drivable to a targeted area at a support surface with uncured concrete placed thereat, and the base unit may include an upper portion that rotates about a base portion to swing the boom and screed head to a targeted location. The concrete surface working machine may include a plurality of stabilizers, which may be extendable and retractable, to support and stabilize the machine on the support surface during the screeding operation. The boom is extendable and retractable to move the screed head 14 over the placed concrete, while the screed head 14 is operable to establish the grade of the concrete surface and to screed the concrete. The screed head 14 includes a rock tamper 16 that comprises a mesh cylinder mounted at opposite ends of the screed head via a mounting structure 18.

Referring now to FIGS. 1-7B, the screed head 14 includes a frame or support portion 14*a*, which supports a plow 14*b*, an auger 14*c*, a vibrating member 14*d*, and the rock tamper 16. The rock tamper 16 includes a metal mesh cylinder 16*a* that is rotatably mounted at opposite ends to a mounting structure 18, such as via opposite ends of a central shaft 16*b* of the tamper being rotatably mounted at respective bearing blocks 20 attached at the lower end of the mounting structure.

Figure 8:
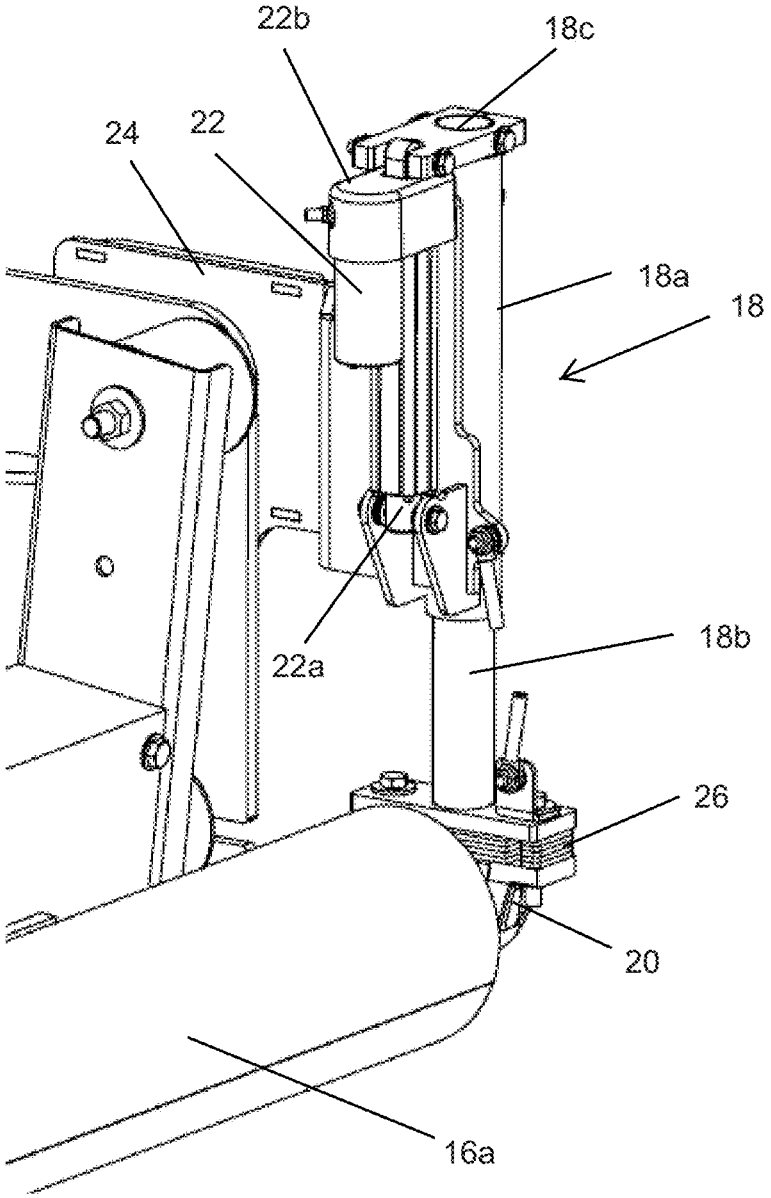
FIG. 8 is a perspective view of one end of the screed head and rock tamper, showing the actuator attached at the end of the screed head.
Figure 9A:
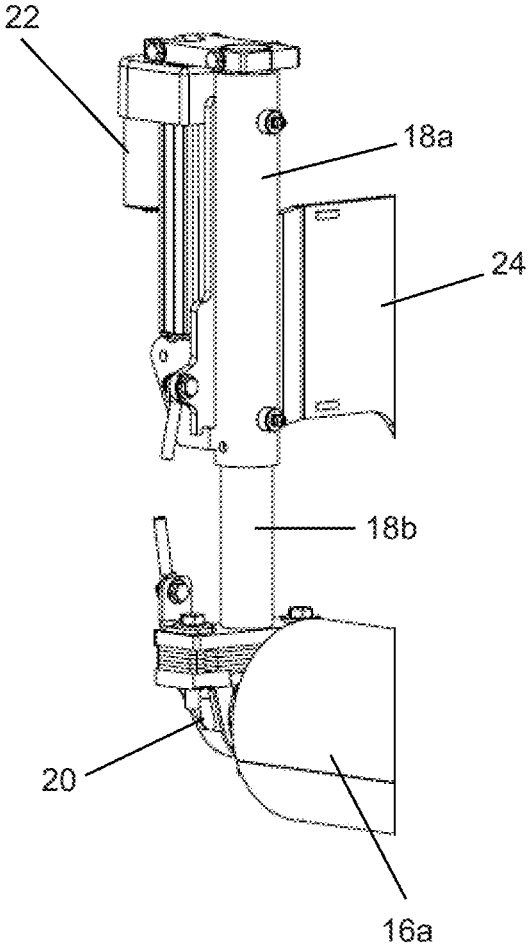
FIG. 9A is a perspective view of the end of the rock tamper and the actuator and spring-loaded support arm.
Figure 9B:
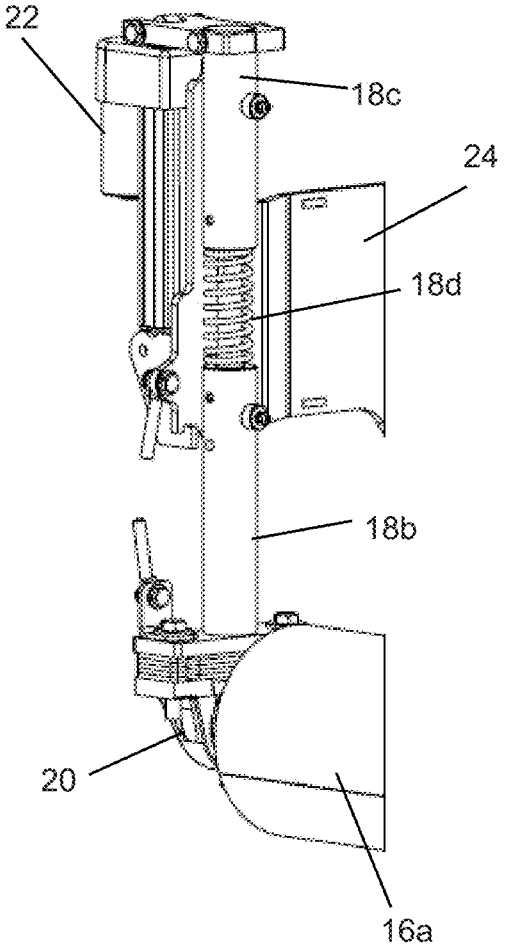
FIG. 9B is another perspective view of the end of the rock tamper and the actuator and spring-loaded support arm, shown with the outer tube of the spring-loaded support arm removed.
Figure 10:
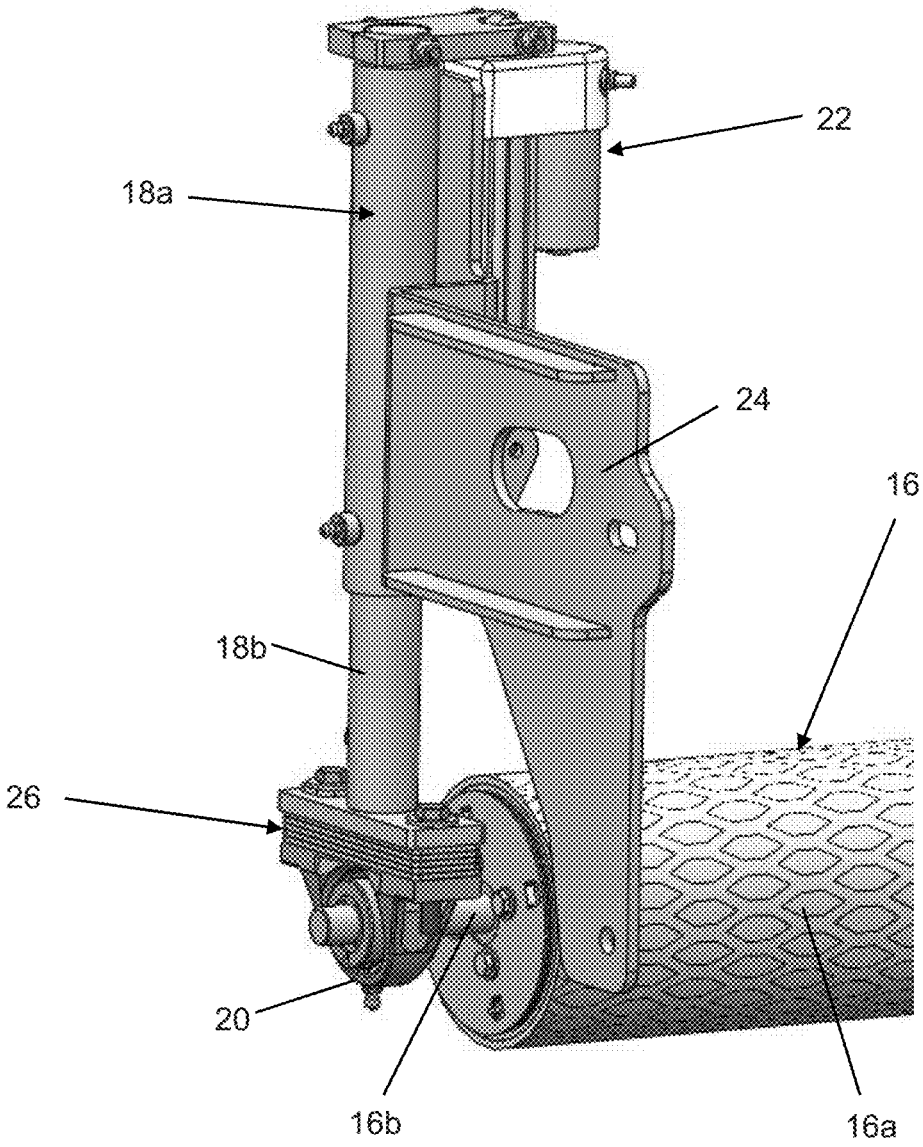
FIG. 10 is a perspective view of the end of the rock tamper and the actuator and spring-loaded support arm, showing shims at the end of the support arm for depth adjustment.
Figure 11:
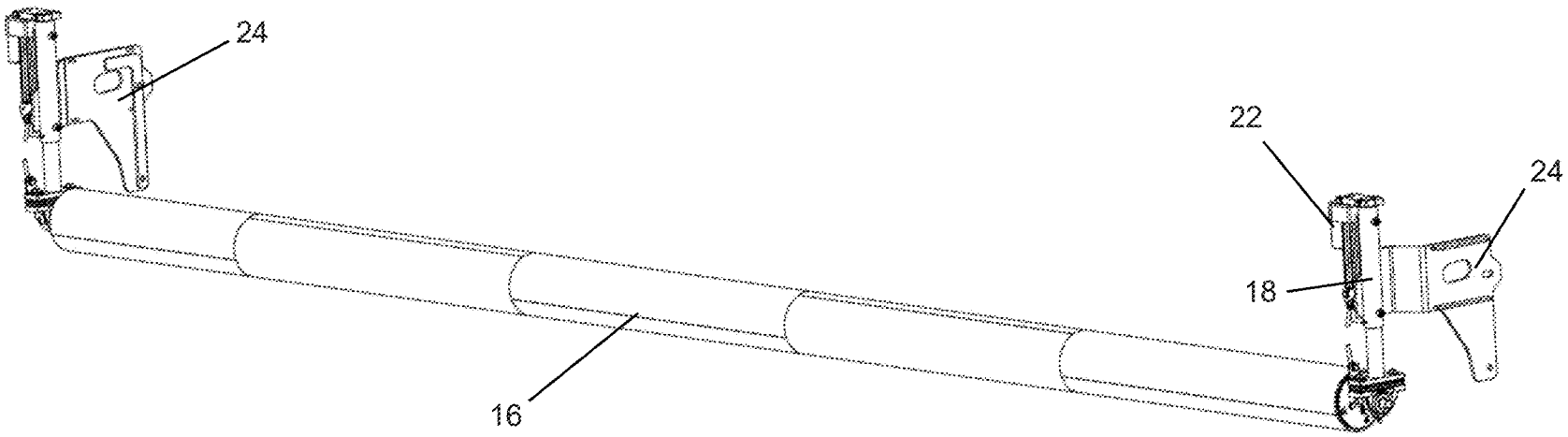
FIG. 11 is a perspective view of the rock tamper having a plurality of replaceable mesh roller segments.

As shown in FIGS. 8-10, the mounting structure 18 includes an outer tube or receiving portion 18*a* that is attached at the respective end of the screed head frame 14*a* and that receives a lower rod or shaft 18*b* and an upper rod or shaft 18*c*, with a biasing element or coil spring 18*d* disposed within the outer tube and between the upper shaft 18*c* and the lower shaft 18*b*. The lower shaft 18*b* is urged or biased downward from the outer tube via the spring disposed within the outer tube, which biases or urges the lower shaft downward away from the upper shaft. An actuator 22 is disposed at each mounting tube 18 and is operable to adjust the height of the rock tamper 16 relative to the frame of the screed head 14 (e.g., to lift the rock tamper upward away from the concrete surface). The mounting tube is attached to a bracket 24, which mounts the mounting tube and rock tamper to the respective end of the frame 14*a* (such as at an auger support beam) of the screed head.

The rock tamper 16 is urged downward to push down the aggregate, so the aggregate does not pop or protrude through the surface during the concrete screeding or working process. If aggregate does protrude through the concrete surface, the small amount of cream covering the aggregate comes off and opens a small hole in the floor. The mesh cylinder 16*a* of the rock tamper 16 is rotatably mounted to the mounting tubes 18 at the lower ends of the inner shaft 16*b* so that, during operation, the mounting tubes urge the rock tamper downward and the mesh cylinder rolls along the concrete surface as the screed head is moved over and along the concrete surface during a screeding pass.

In the illustrated embodiment, the actuator 22 is disposed at each mounting tube 18 and is operable to move the upper shaft 18*c* relative to outer tube 18*a*, which compresses or relaxes the spring 18*d* and moves the lower shaft 18*b* relative to the outer tube to adjust the height of the rock tamper 16 relative to the frame of the screed head 14. As best shown in FIGS. 8, 9A, and 9B, one end 22*a* of the actuator 22 is attached at or fixed relative to the frame 14*a* (such as attached at the outer tube 18*a* and/or bracket 24) and the other end 22*b* of the actuator is attached at the upper end of the upper shaft 18*c*. Thus, when the actuator is extended, the actuator moves the upper shaft 18*c* upward, which pulls upward at the spring and thus pulls upward at the lower shaft 18*b*, thereby raising the rock tamper relative to the frame of the screed head (and/or reducing the spring force applied by the spring). When the actuator is lowered, the actuator moves the upper shaft 18*c* downward, which pushes downward at the spring and thus pushes the lower shaft 18*b* downward, thereby lowering the rock tamper relative to the frame of the screed head (and/or increasing the spring force applied by the spring). Optionally, the mounting tubes or mounting structure may not be spring-biased. For example, the mounting structure may comprise a single rod or element that is attached at the bearing block or rock tamper and that is movable by the actuator. The single rod or element may be movably disposed at a mounting tube or structure and vertically movable relative to the mounting structure (and relative to the frame and screed head) via the actuator. Thus, the rock tamper may be raised and lowered via the actuator and may be lowered into the concrete with no downward spring-biasing, such that the depth of engagement of the rock tamper with the concrete surface is established by the number of shims or thickness of the shims and/or the actuator.

The actuators thus can lift the roller of the rock tamper out of the concrete if necessary for some passes. For example, if the operator utilizes head rotate or machine rotate to move around a column, the metal roll or tamper would tear the concrete surface, but the actuators allow for the operator to raise the rock tamper out of the concrete during such operations. The actuators and mounting structure also allow the operator to set the depth of the roller or tamper at or above or below grade, such as by extending or retracting the actuator to raise or lower the tamper via control of the actuators at the operator seat. Also, the operator may increase the depth and/or pressure of the tamper at the concrete surface via controlling the actuator, such as for when the concrete slump decreases (i.e., the concrete gets harder) by retracting the actuator which compresses the spring and urges the lower shaft and the tamper downward.

The actuators may comprise hydraulic cylinder actuators or electrical linear actuators or other suitable actuators. For example, the actuators may comprise electric actuators that operate via a 12 volt power supply, and may provide position feedback to the system and/or operator. An example of a suitable actuator may be a linear actuator commercially available from Warner Electric of South Beloit, IL. The actuator may provide position feedback, and may have a built in brake, and is strong enough to raise and lower the tamper and to provide the desired height of the tamper relative to the auger. The actuator may operate to extend and/or retract at, for example, about 2 inches/second (under no load) or faster to provide the desired responsiveness when the operator actuates the actuator to raise or lower the tamper.

The actuators are disposed at respective ends of the roller or rock tamper and actuate to a position set by the operator, such as based on the slump of the concrete being worked. For example, if the concrete has a higher slump (less set up or more freshly placed), the operator may actuate the actuators to raise the roller and/or decrease the force applied by the spring. Similarly, if the concrete has a lower slump (more set up or partially cured), the operator may actuate the actuators to lower the roller and/or increase the force applied by the spring. Optionally, the actuators may operate to provide a soft landing of the roller/tamper at the concrete surface, such as at the start of a tamping pass (such as by utilizing aspects of the systems described in U.S. Pat. Nos. 8,038,365; 7,677,834; 7,396,186; 7,175,363 and/or 7,044,681, which are hereby incorporated herein by reference in their entireties).

Optionally, the actuators may comprise manual lift mechanism or manually actuated actuators with a locking mechanism, whereby an operator can manually raise the rock tamper, and the locking mechanism is engaged (such as via a latch latching the rock tamper in place when raised to a threshold level) to retain the rock tamper at the raised position. When it is desired to lower the rock tamper back down, the latch mechanism may be disengaged by the operator, and the rock tamper may be lowered to the concrete surface (such as in a controlled or dampened manner so that the rock tamper slowly lowers into engagement with the concrete surface).

As discussed above, the rock tamper 16 includes the metal mesh cylinder 16*a*, which is attached at the rod or shaft 16*b*, which in turn is mounted at each end to the bearing blocks 20. The bearing blocks 20 are attached at the lower end of the lower tube 18*b* of the mounting tube 18. Optionally, and such as shown in FIG. 10, the bearing block 20 may be mounted at the lower end of the lower tube 18*b* via a plurality of shims 26. The number of shims and/or thickness of the shims may be selected and implemented to provide adjustment of the height or depth (or downward position) of the rock tamper. Optionally, the actuator may fully extend to raise the rock tamper and may be fully retracted to lower the rock tamper, whereby the depth of the rock tamper is established by selecting an appropriate amount or thickness of the shims. The mounting tube or mounting structure may comprise a spring-biased element or rod or tube, as described above, or the mounting tube or mounting structure may comprise a single rod or element and is not spring-biased.

Optionally, and such as shown in FIGS. 11-19, the mesh cylinder 16*a* of the rock tamper may comprise a plurality of removable and replaceable mesh cylinder segments. The mesh cylinder segments comprise the outer mesh element 28 that is attached to end plates 30 and optionally one or more internal support plates or disks 32. The end plates 30 and internal disks 32 have a central passageway that is configured to receive the roller shaft 16*b* of the rock tamper 16 therethrough when the mesh cylinder is disposed at the shaft 16*b*.

Figure 16:
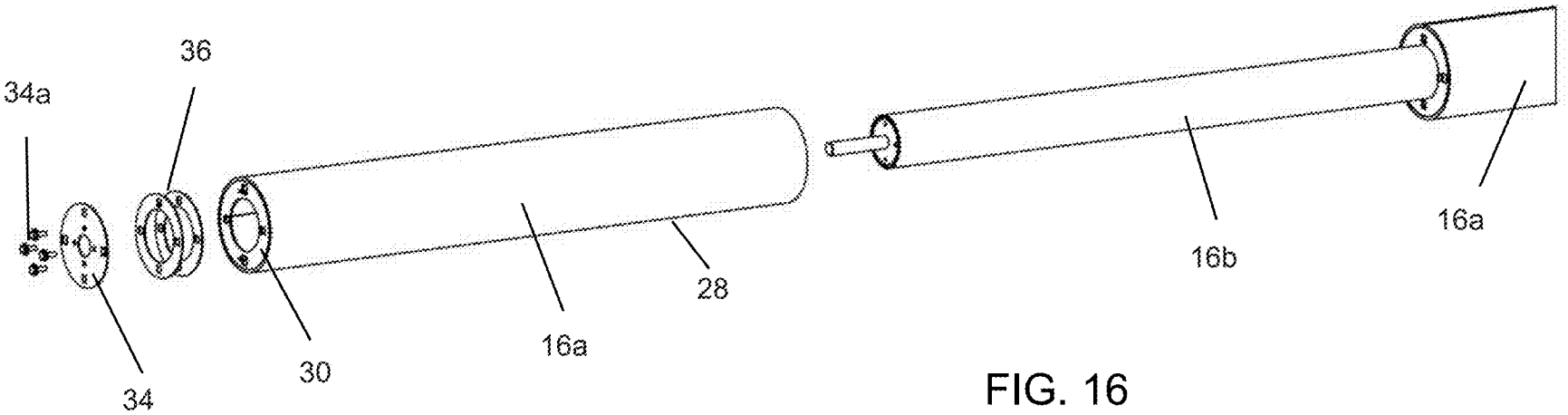
FIG. 16 is an exploded perspective view of an end of the rock tamper, showing the end mesh roller segment removed from the roller shaft.
Figure 14:
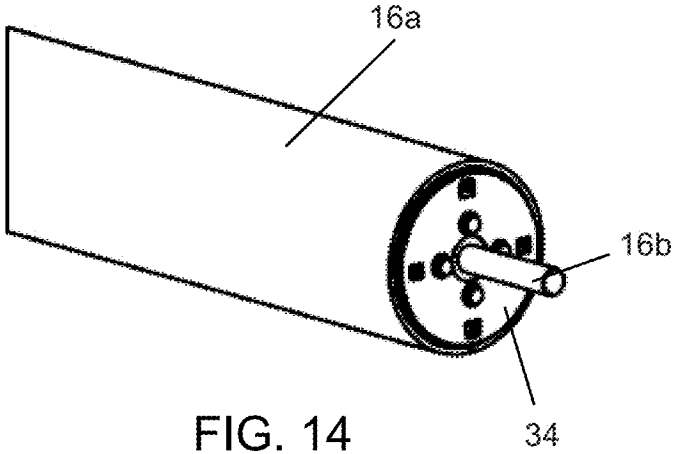
FIG. 14 is a perspective view of an end of a mesh roller segment.
Figure 15:
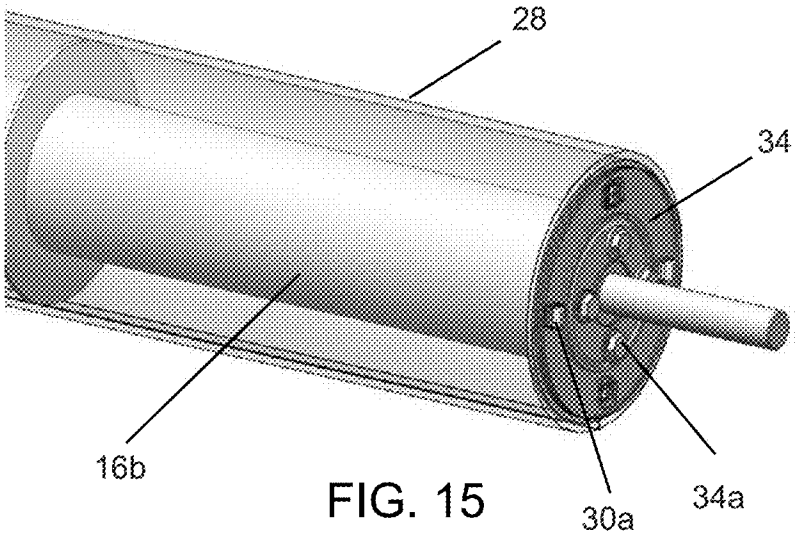
FIG. 15 another perspective view of the end of the mesh roller segment, with the outer mesh element transparent to show the roller shaft of the rock tamper.
Figure 12:
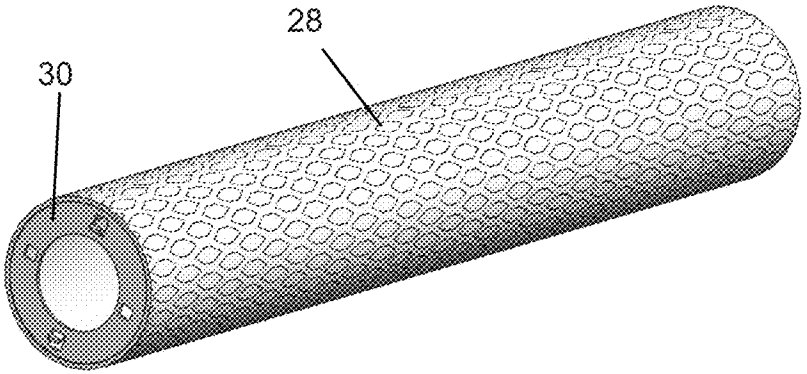
FIG. 12 is a perspective view of one of the replaceable mesh roller segments.
Figure 13:
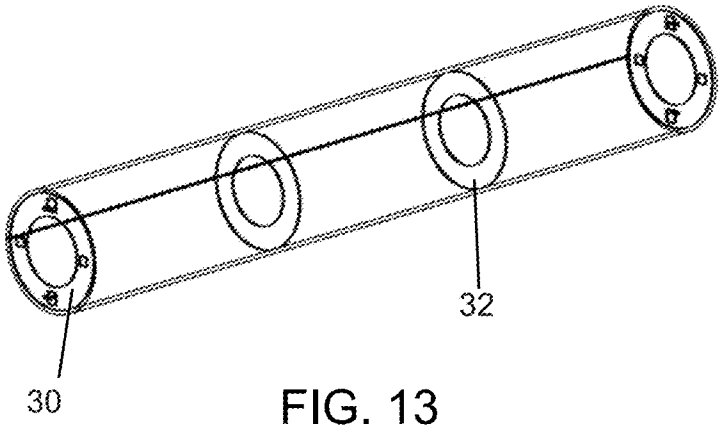
FIG. 13 is another perspective view of the replaceable mesh roller segment, shown with the outer mesh element transparent.
Figure 18:
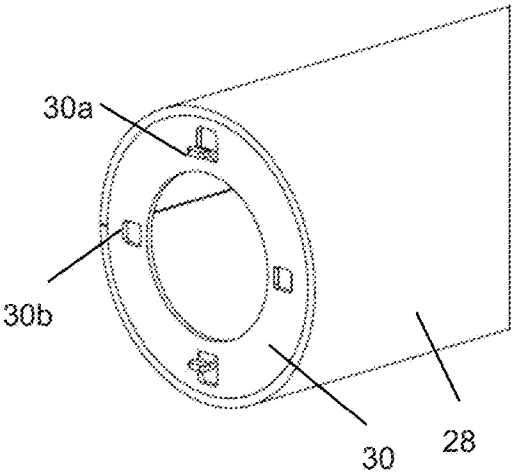
FIG. 18 is a perspective view of one of the mesh roller segments, showing tabs and apertures for connecting the mesh roller segment to another mesh roller segment of the rock tamper.
Figure 17:
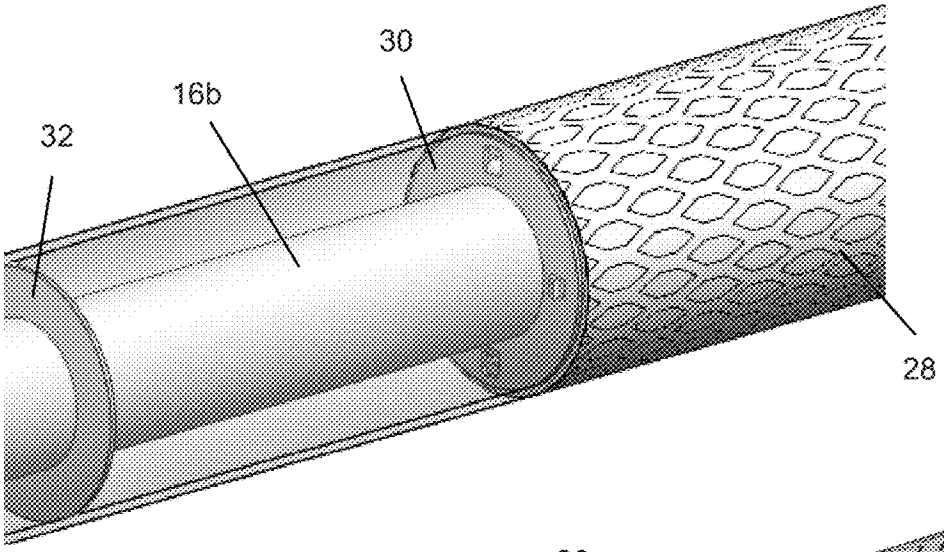
FIG. 17 is a perspective view of a portion of the rock tamper, with the outer mesh element of one of the mesh roller segments transparent to show the connection of the mesh roller segments along the roller shaft.
Figure 19:
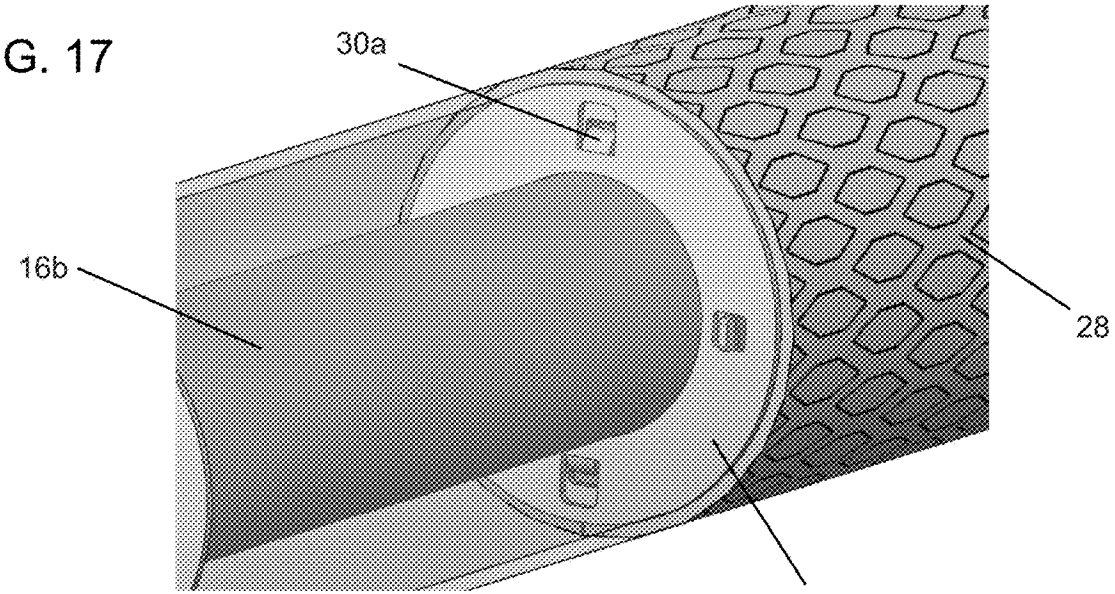
FIG. 19 is an enlarged perspective view of a portion of the rock tamper, showing the connection of adjacent mesh roller segments, with the outer mesh element of one of the segments transparent.
Figure 20:
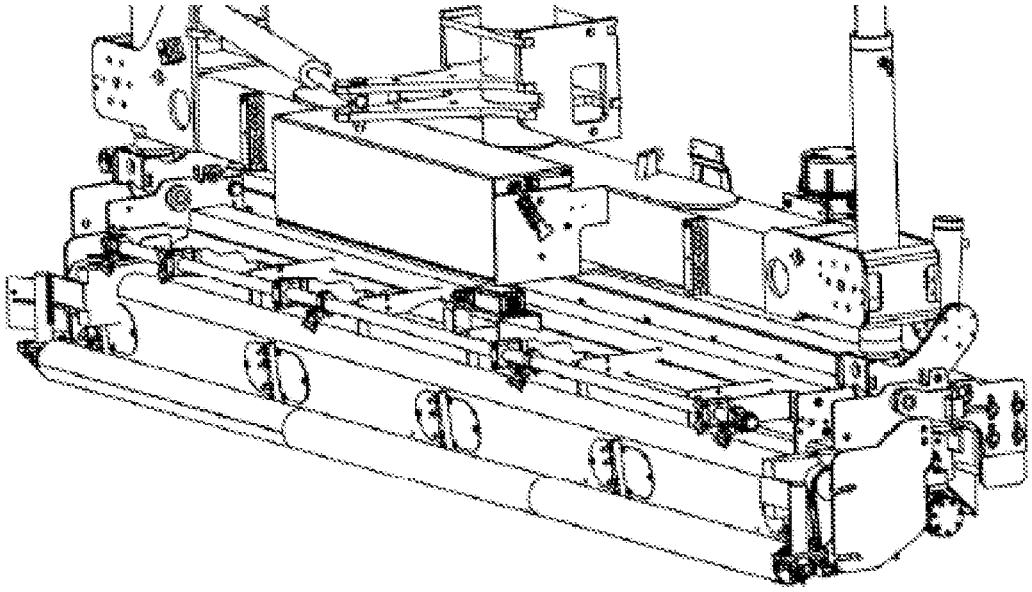
FIGS. 20 and 21 are views of a known screed head with rock tamper.
Figure 21:
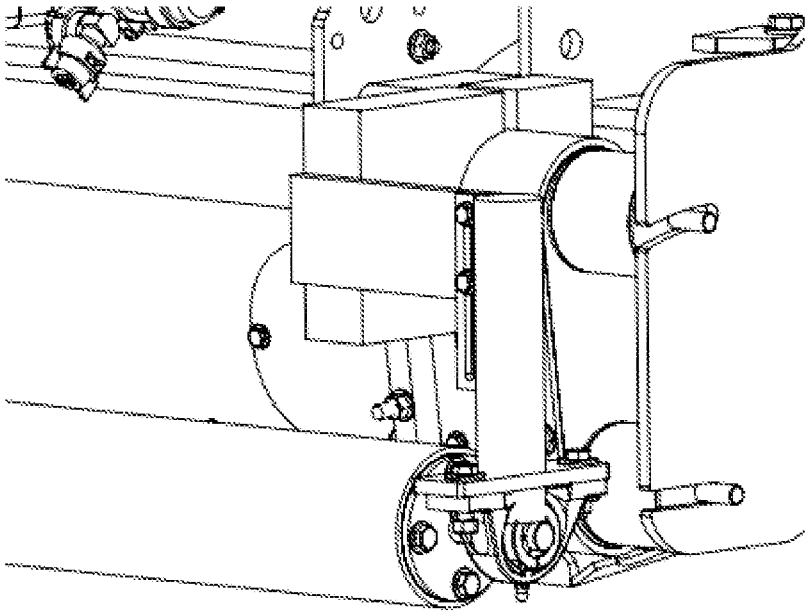

In the illustrated embodiment, and as best seen with reference to FIGS. 17-19, the end plates 30 include a plurality of tabs 30*a* and apertures 30*b*, which are configured to engage a corresponding plurality of apertures 30*b* and tabs 30*a* of an end plate 30 of an adjacent mesh cylinder segment when multiple mesh cylinder segments are disposed at the roller shaft 16*b*. An end plate 34 is fastened at each end of the roller shaft (such as via a plurality of fasteners 34*a*), with the end plates 34 also including tabs and apertures for engaging the outer end plates of the respective outer segments. The end plates 34 provide a mechanical stop that limits movement of the mesh segments along the roller shaft. Additional disks or shims 36 may be provided between the outer end plate 34 and the end plate 30 of the outer segment 16*a* to limit movement of the segments 16*a* along the shaft 16*b*. As shown in FIGS. 15 and 16, the roller shaft includes a larger diameter portion that is received through the apertures of the end plates 30 and internal plates 32 and the shims 36 and a smaller diameter portion that is received through a smaller aperture of each end plate 34, whereby the smaller diameter shaft is received in the bearing blocks 20 to rotatably mount the rock tamper at the screed head. The tabs of the end plates are received in the corresponding holes of adjacent end plates to join the segments together and to ensure that all of the segments rotate with the main shaft.

Thus, the fastened or bolted end plates and the segment end plates each include corresponding interlocking tabs/holes to ensure the entire assembly rotates as one unit. As shown in FIG. 16, shims may be added or removed at each/either end of the rock tamper as necessary to ensure assembly is tight so that the mesh segments do not move longitudinally along the roller shaft. The shims only contain holes for receiving the tabs of the end plates. Optionally, the end plates of the roller shaft and of the segments may not include tabs and holes for non-rotatably connecting the segments to one another and/or to the end plates, such that the segments may individually rotate with or relative to the roller shaft and/or relative to one another as the screed head moves along the concrete surface. Optionally, each roller segment may have its own respective shaft and the shafts may be rotatably or non-rotatably connected to form the rock tamper. The shafts of the roller segments may rotate together or independent of one another and/or the mesh of the segments may rotate together or independent of one another.

The roller shaft may have an end plate attached at one end, whereby a first segment is slid onto the roller shaft and connected to the roller shaft end plate, and then additional segments are slid onto the roller shaft and connected to one another. After the last segment is at the roller shaft, the shims and other end plate are installed at that end of the roller shaft to complete the rock tamper assembly. If one or more of the segments is damaged, the damaged segment(s) can be replaced by removing one of the end plates and removing the segment and replacing just the damaged segment with a new segment. Optionally, the mesh segments may be provided with different mesh size or screen size (i.e., different sized holes or gaps) and may be changed to accommodate different sized aggregate or to function to push down the aggregate in different amounts (e.g., smaller screen size will push down more of the smaller aggregate and allow less aggregate to pass through the mesh into the cylinder). For example, the mesh may comprise a ½ inch mesh size, which has a rough diamond-shaped opening of about ⅜ inch by ¾ inch, but other suitable sizes may include, for example, ¼ inch, ¾ inch or 1¼ inch.

The rock tamper thus functions to push the aggregate lower into the slab of concrete than the normal screed head would. For lower slump (stiffer) concrete mixes, the rock tamper may run at a lower elevation (relative to the bottom of the auger) than it would for a higher slump (wetter) mix. By running the rock tamper 'lower' it will stiffen the spring so that when the roller engages the concrete, the concrete will push the roll upwards thereby compressing the spring and allowing more down pressure onto the surface of the concrete. For wet mixes, the spring may not compress, so the elevation of the rock tamp may be set higher, perhaps only, for example, one-quarter inch below the auger and just enough to make sure the rock gets pushed below the surface (such adjustment may be achieved via actuation of the actuator or adding or removing one or more shims at the bearing block). For either mix, the result should be the same—the rock should be some amount below the surface of the concrete, such as between, for example one-eighth of an inch to one-quarter of an inch or thereabouts.

The controller of the screeding machine individually controls the elevation cylinders of the screed head responsive to signals generated by the laser receivers, which sense a laser reference plane generated at the work site. Optionally, the screed head may be responsive to other sensors, such as ultrasonic sensors or laser sensors or the like that sense and maintain a distance or height of the head at and over the concrete surface, such as by utilizing aspects of the machines described in U.S. Pat. No. 6,227,761, which is hereby incorporated herein by reference in its entirety.

The screeding machine and the screed head or assembly may be similar in construction and/or operation as the screeding and/or finishing and/or spraying machines and heads described in U.S. Pat. Nos. 4,655,633; 4,930,935; 7,044,681; 7,175,363; 7,396,186; 9,835,610; 10,156,048 and/or 10,895,045, and/or U.S. Publication Nos. US-2022-0316154; US-2010-0196096 and/or US-2007-0116520, which are all hereby incorporated herein by reference in their entireties, such that a detailed discussion of the overall construction and operation of the machines and heads need not be repeated herein. However, aspects of this screeding and tamping machine are suitable for use on other types of machines. For example, the screed head and tamper may be suitable for use on a smaller machine, such as a machine of the types described in U.S. Pat. Nos. 6,976,805; 7,121,762 and/or 7,850,396, which are hereby incorporated herein by reference in their entireties. Optionally, the screed head may be used on other types of machines, such as a machine with the head mounted at an articulatable boom, such as of the types described in U.S. Pat. No. 10,190,268, which is hereby incorporated herein by reference in its entirety.

Therefore, the concrete surface working machine provides a rock tamper on a concrete screeding head and allows for selective adjustment of the height (and/or down pressure) of the rock tamper relative to the frame of the screed head (and thus relative to the plow and/or vibrating member of the screed head) via extension and retraction of the actuators. Thus, the height of the rock tamper and/or the spring force applied by the spring may be selectively set via the shims and/or selectively controlled by an operator to allow for increasing depth of the tamper into the concrete surface when used at firmer or more set concrete and raising the rock tamper off the concrete surface during particular screed head maneuvers, such as when the screed head is rotated or the machine rotates to move the screed head around a column.

Although shown and described as being disposed at a screed head having a vibrating member, the rock tamper and actuators and mounting structures may be disposed at other concrete surface working or finishing machines or devices, such as at a finishing machine with an adjustable float, such as a spraying and/or brooming and/or floating and/or finishing machine that utilizes aspects of the machines described in U.S. Publication No. US-2022-0316154, which is hereby incorporated herein by reference in its entirety. For example, the rock tamper may be installed on a broom and cure device to tamp the concrete surface ahead of a bull float of the concrete finishing machine. Also, although shown and described as being located at the screed head at a rearward or following position that would be behind and follow the plow and vibrating element during a screeding pass, the rock tamper may be positioned at the forward or leading end or side of the screed head to engage the concrete surface ahead of the surface working element (e.g., plow and vibrating element) as the screed head is moved over the concrete surface in a screeding direction. Optionally, with the rock tamper disposed at the trailing or following side of the screed head, the rock tamper may engage the concrete surface during extension of the boom, and the plow and vibrating element may engage the concrete surface during retraction of the boom. Optionally, with the rock tamper disposed at the leading side of the screed head, the rock tamper and the plow and vibrating element may engage the concrete surface during retraction of the boom.

Also, although shown and described as being adjustably disposed at the screed head, the rock tamper may be fixedly disposed at the screed head (or other concrete surface working or finishing machine), with the screeding element and grade setting member (or other working or finishing element or device) adjustable relative to the screed head and rock tamper. The vibrating element or other concrete finishing element may be adjusted relative to the rock tamper during the screeding or finishing pass along the concrete surface.

Changes and modifications to the specifically described embodiments can be carried out without departing from the principles of the present invention, which is intended to be limited only by the scope of the appended claims as interpreted according to the principles of patent law.

The invention claimed is:

1. A concrete surface working machine, the concrete surface working machine comprising:

a base portion and a screed head mounted at the base portion;

wherein the screed head comprises a grade setting device and a vibrating element attached at a frame of the screed head, and wherein the grade setting device operates to establish a grade of a concrete surface, and wherein the vibrating element operates to screed the concrete surface at the established grade;

wherein the screed head comprises a rock tamper adjustably attached at the frame of the screed head via a pair of support elements;

wherein the screed head comprises a pair of actuators that, when operated, adjust the support elements to adjust the rock tamper relative to the frame;

wherein the concrete surface working machine is operable to position the vibrating element at the concrete surface;

wherein the actuators are operated by an operator of the concrete surface working machine to adjust a height of the rock tamper relative to the vibrating element and the concrete surface while the screed head is moved along the concrete surface; and wherein the support elements each comprise a spring-loaded support element having a biasing element that urges the rock tamper downward relative to the frame.

2. The concrete surface working machine of claim 1, wherein the rock tamper is mounted at a lower portion of the respective support elements and the actuators, when operated, adjust an upper portion of the respective support elements, and wherein the biasing element is disposed between the respective upper portion and the respective lower portion and biases the lower portion away from the upper portion.

3. The concrete surface working machine of claim 2, wherein the support elements each comprise an outer tube, and wherein the upper portion and the lower portion are partially received at respective ends of the outer tube with the biasing element disposed within the outer tube.

4. The concrete surface working machine of claim 3, wherein each actuator comprises an electrically operable linear actuator with one end attached at the respective outer tube and another end attached at an upper end region of the respective upper portion.

5. The concrete surface working machine of claim 3, wherein each actuator comprises a hydraulic actuator with one end attached at the respective outer tube and another end attached at an upper end region of the respective upper portion.

6. The concrete surface working machine of claim 1, wherein the actuators are operated by the operator of the concrete surface working machine to adjust a biasing force applied by the biasing element while the screed head is moved along the concrete surface.

7. The concrete surface working machine of claim 1, wherein the actuators are operated by the operator of the concrete surface working machine to adjust a down pressure of the rock tamper at the concrete surface while the screed head is moved along the concrete surface.

8. The concrete surface working machine of claim 1, wherein the actuators are operated by the operator of the concrete surface working machine to raise the rock tamper above the concrete surface while the screed head is moved along the concrete surface.

9. The concrete surface working machine of claim 1, wherein the rock tamper comprises a cylindrical mesh element attached at a shaft, and wherein the shaft is rotatably attached at a lower end of each of the support elements.

10. The concrete surface working machine of claim 9, wherein the rock tamper comprises a plurality of cylindrical mesh elements disposed along the shaft.

11. The concrete surface working machine of claim 10, wherein the plurality of cylindrical mesh elements are attached at end plates, and wherein adjacent end plates of adjacent cylindrical mesh elements non-rotatably connect with one another.

12. The concrete surface working machine of claim 11, wherein a shaft end plate is attached at each end of the shaft and non-rotatably connects with an outer end plate of a respective outer cylindrical mesh element.

13. The concrete surface working machine of claim 10, wherein the plurality of cylindrical mesh elements are independently rotatable about the shaft.

14. The concrete surface working machine of claim 9, wherein the ends of the shaft are adjustably mounted at the lower ends of the support elements via a plurality of shims at the lower ends of the support elements.

15. The concrete surface working machine of claim 1, wherein the screed head is mounted at the base portion via an extendable and retractable boom that extends or retracts to move the screed head during a screeding pass.

16. The concrete surface working machine of claim 1, wherein the base portion is movable along the concrete surface to move the screed head during a screeding pass.

17. The concrete surface working machine of claim 1, wherein, while the screed head is moved along the concrete surface, the rock tamper engages the concrete surface behind the vibrating element.

18. A concrete surface working machine, the concrete surface working machine comprising:

a base portion and a screed head mounted at the base portion;

wherein the screed head comprises a grade setting device and a vibrating element attached at a frame of the screed head, and wherein the grade setting device operates to establish a grade of a concrete surface, and wherein the vibrating element operates to screed the concrete surface at the established grade;

wherein the screed head comprises a rock tamper adjustably attached at the frame of the screed head via a pair of support elements;

wherein the screed head comprises a pair of actuators that, when operated, adjust the support elements to adjust the rock tamper relative to the frame;

wherein the concrete surface working machine is operable to position the vibrating element at the concrete surface;

wherein the actuators are operated by an operator of the concrete surface working machine to adjust a height of the rock tamper relative to the vibrating element and the concrete surface while the screed head is moved along the concrete surface; and wherein the actuators are manually operated by the operator of the concrete surface working machine to raise the rock tamper above the concrete surface and to engage the rock tamper with a locking mechanism to retain the rock tamper in the raised position.

19. The concrete surface working machine of claim 18, wherein the support elements each comprise a spring-loaded support element having a biasing element that urges the rock tamper downward relative to the frame.

20. A concrete surface working machine, the concrete surface working machine comprising:

a base portion and a screed head mounted at the base portion;

wherein the screed head comprises a grade setting device and a vibrating element attached at a frame of the screed head, and wherein the grade setting device operates to establish a grade of a concrete surface, and wherein the vibrating element operates to screed the concrete surface at the established grade;

wherein the screed head comprises a rock tamper adjustably attached at the frame of the screed head via a pair of support elements;

wherein the screed head comprises a pair of actuators that, when operated, adjust the support elements to adjust the rock tamper relative to the frame;

wherein the concrete surface working machine is operable to position the vibrating element at the concrete surface;

wherein the actuators are operated by an operator of the concrete surface working machine to adjust a height of the rock tamper relative to the vibrating element and the concrete surface while the screed head is moved along the concrete surface; and wherein, while the screed head is moved along the concrete surface, the rock tamper engages the concrete surface ahead of the vibrating element.

21. A concrete surface working machine, the concrete surface working machine comprising:

a base portion and a surface working head mounted at the base portion;

wherein the surface working head comprises a surface working element attached at a frame of the surface working head;

wherein the surface working head comprises a rock tamper adjustably attached at the frame of the surface working head via a pair of support elements;

wherein the surface working head comprises a pair of actuators that, when operated, adjust the support elements to adjust the rock tamper relative to the frame;

wherein the concrete surface working machine is operable to position the surface working element at the concrete surface;

wherein the actuators are operated by an operator of the concrete surface working machine to adjust a height of the rock tamper relative to the surface working element and the concrete surface while the surface working head is moved along the concrete surface; and wherein the actuators are manually operated by the operator of the concrete surface working machine to raise the rock tamper above the concrete surface and to engage the rock tamper with a locking mechanism to retain the rock tamper in the raised position.

22. The concrete surface working machine of claim 21, wherein the actuators are operated by the operator of the concrete surface working machine to adjust a down pressure of the rock tamper at the concrete surface while the surface working head is moved along the concrete surface.

23. The concrete surface working machine of claim 21, wherein the actuators are operated by the operator of the concrete surface working machine to raise the rock tamper above the concrete surface while the surface working head is moved along the concrete surface.

24. The concrete surface working machine of claim 21, wherein the rock tamper comprises a cylindrical mesh element attached at a shaft, and wherein the shaft is rotatably attached at a lower end of each of the support elements.

25. The concrete surface working machine of claim 24, wherein the rock tamper comprises a plurality of cylindrical mesh elements disposed along the shaft.

26. The concrete surface working machine of claim 25, wherein the plurality of cylindrical mesh elements are attached at end plates, and wherein adjacent end plates of adjacent cylindrical mesh elements non-rotatably connect with one another.

27. The concrete surface working machine of claim 26, wherein a shaft end plate is attached at each end of the shaft and non-rotatably connects with an outer end plate of a respective outer cylindrical mesh element.

28. The concrete surface working machine of claim 25, wherein the plurality of cylindrical mesh elements are independently rotatable about the shaft.

29. The concrete surface working machine of claim 21, wherein, while the surface working head is moved along the concrete surface, the rock tamper engages the concrete surface behind the surface working element.

30. The concrete surface working machine of claim 21, wherein, while the surface working head is moved along the concrete surface, the rock tamper engages the concrete surface ahead of the surface working element.

31. A concrete surface working machine, the concrete surface working machine comprising:

a base portion and a surface working head mounted at the base portion;

wherein the surface working head comprises a surface working element attached at a frame of the surface working head;

wherein the surface working head comprises a rock tamper adjustably attached at the frame of the surface working head via a pair of support elements;

wherein the surface working head comprises a pair of actuators that, when operated, adjust the support elements to adjust the rock tamper relative to the frame;

wherein the concrete surface working machine is operable to position the surface working element at the concrete surface;

wherein the actuators are operated by an operator of the concrete surface working machine to adjust a height of the rock tamper relative to the surface working element and the concrete surface while the surface working head is moved along the concrete surface; and wherein the support elements each comprise a spring-loaded support element having a biasing element that urges the rock tamper downward relative to the frame.

32. The concrete surface working machine of claim 31, wherein the rock tamper is mounted at a lower portion of the respective support elements and the actuators, when operated, adjust an upper portion of the respective support elements, and wherein the biasing element is disposed between the respective upper portion and the respective lower portion and biases the lower portion away from the upper portion.

33. The concrete surface working machine of claim 32, wherein the support elements each comprise an outer tube, and wherein the upper portion and the lower portion are partially received at respective ends of the outer tube with the biasing element disposed within the outer tube.

34. The concrete surface working machine of claim 33, wherein each actuator comprises an electrically operable linear actuator with one end attached at the respective outer tube and another end attached at an upper end region of the respective upper portion.

35. The concrete surface working machine of claim 33, wherein each actuator comprises a hydraulic actuator with one end attached at the respective outer tube and another end attached at an upper end region of the respective upper portion.

36. The concrete surface working machine of claim 31, wherein the actuators are operated by the operator of the concrete surface working machine to adjust a biasing force applied by the biasing element while the surface working head is moved along the concrete surface.

37. The concrete surface working machine of claim 31, wherein the actuators are manually operated by the operator of the concrete surface working machine to raise the rock tamper above the concrete surface and to engage the rock tamper with a locking mechanism to retain the rock tamper in the raised position.

38. A concrete surface working machine, the concrete surface working machine comprising:

a base portion and a surface working head mounted at the base portion;

wherein the surface working head comprises a surface working element attached at a frame of the surface working head;

wherein the surface working head comprises a rock tamper adjustably attached at the frame of the surface working head via a pair of support elements;

wherein the surface working head comprises a pair of actuators that, when operated, adjust the support elements to adjust the rock tamper relative to the frame;

wherein the concrete surface working machine is operable to position the surface working element at the concrete surface;

wherein the actuators are operated by an operator of the concrete surface working machine to adjust a height of the rock tamper relative to the surface working element and the concrete surface while the surface working head is moved along the concrete surface;

wherein the rock tamper comprises a cylindrical mesh element attached at a shaft, and wherein the shaft is rotatably attached at a lower end of each of the support elements; and wherein the ends of the shaft are adjustably mounted at the lower ends of the support elements via a plurality of shims at the lower ends of the support elements.

* * * * *